United States Patent [19]

Geiger et al.

[11] 4,334,554

[45] Jun. 15, 1982

[54] REMOVABLE ORIFICE

[75] Inventors: Walter R. Geiger, Madison Borough; Boyd A. Kessinger, Murrysville Borough, both of Pa.

[73] Assignee: Westinghouse Electric Corp., Pittsburgh, Pa.

[21] Appl. No.: 180,051

[22] Filed: Aug. 20, 1980

[51] Int. Cl.[3] ..... F15D 1/02

[52] U.S. Cl. ..... 138/44; 138/40; 122/406 B; 285/39; 285/DIG. 22

[58] Field of Search ..... 138/40, 44; 239/600; 285/39, 319, DIG. 22; 122/406 B

[56] References Cited

U.S. PATENT DOCUMENTS

| | | | |
|---|---|---|---|
| 1,850,281 | 3/1932 | La Mont | 122/406 B |
| 2,415,992 | 2/1947 | Clair | 138/40 X |
| 3,225,749 | 12/1965 | Froot | 138/40 X |
| 4,054,157 | 10/1977 | Moseley | 138/40 X |

*Primary Examiner*—Steven L. Stephan
*Assistant Examiner*—Daniel P. Stodola
*Attorney, Agent, or Firm*—F. J. Baehr, Jr.

[57] ABSTRACT

Orifices which are removably attached to individual tubes of a steam generator.

5 Claims, 1 Drawing Figure

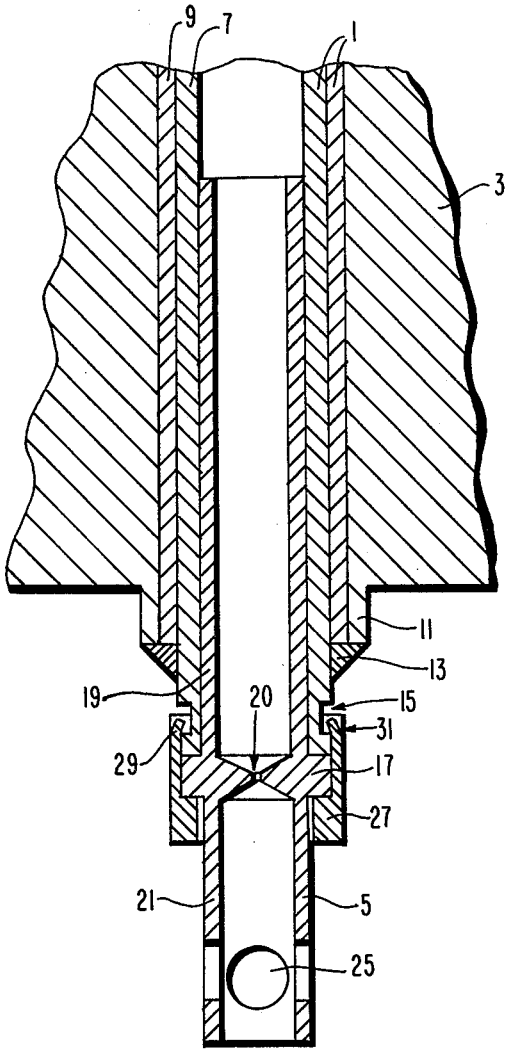
9
7
1
3
11
13
19
20
15
31
29
17
27
21
5
25

REMOVABLE ORIFICE

BACKGROUND OF THE INVENTION

This invention relates to orifices for heat exchangers and more particularly to removable orifices for a steam generator.

Orifices are required in steam generators in which steam is produced in the tubes to regulate the flow of feedwater to each individual tube and prevent instability within the steam generator. As orifices have relatively small openings, they are susceptible to damage due to erosion, corrosion or a combination thereof and in order to gain access to the inside of the tubes for cleaning, servicing and inspecting, it is desirable to provide removable orifices.

Since the steam generator comprises 10,000 or more tubes, orifices which are securely fastened to the tubes, but which can be quickly removed are important to provide economical and workable steam generator.

SUMMARY OF THE INVENTION

In general, a removable orifice for a tube having a circumferential groove in its outer surface when made in accordance with this invention comprises an orifice block having an orifice disposed therein and having an outer diameter generally equal to the outer diameter of the outer surface of the tube, a skirt extending from one end of the orifice block and fitting inside the tube and a sleeve having a counterbore which fits over the outer diameter of the orifice block. The counterbored end of the sleeve extends beyond the outer edge of the circumferential groove and the end of the sleeve is bent at a plurality of locations so as to engage the sleeve and hold the orifice adjacent the tube.

BRIEF DESCRIPTION OF THE DRAWINGS

The objects and advantages of this invention will become more apparent from reading the following detailed description in connection with the sole FIGURE in which the sole FIGURE is a partial sectional view of a steam generator tube with a removable orifice made in accordance with this invention.

DESCRIPTION OF THE PREFERRED EMBODIMENT

Referring now to the sole FIGURE in detail, there is shown a double-walled tube 1 of a steam generator (not shown) having a tubesheet 3 and a removable orifice 5 disposed in the end of the tube 1.

The tube 1 has an inner and outer wall 7 and 9, respectively. A boss 11 is disposed on the tubesheet and the outer wall 9 of the tube is welded to the boss by a weld 13 which forms a seal between the boss 11 the outer wall 9 of the tube and the inner wall 7 of the tube. The inner wall 7 of the tube 1 extends beyond the boss 11 and the outer wall 9 and has a circumferential groove

15 disposed on the outer surface thereof adjacent the distal end.

The orifice 5 comprises an orifice block 17 having a skirt 19 extending from one side thereof, a collar 21 extending from the other side thereof and an orifice 20 disposed within the orifice block.

The skirt 19 fits within the tube 1 and the collar 21 has a plurality of holes 25 in the tubular walls forming the collar 21. The skirt 19, collar 21 and orifice 20 have a common longitudinal axis. The orifice block 17 has an outer diameter generally equal to the outer diameter of the inner wall portion 7 of the tube 1.

A sleeve 27 has a counterbore 29, which fits over the orifice block 17 and extends into the sleeve so that the counterbored end of the sleeve 27 is beyond the outer edge or margin of the circumferential groove 15 when the inner end of the counterbore is adjacent the orifice block 17 and the orifice block is abutting the tube 1. The outer margin of the counterbored end of the sleeve 27 is bent inwardly forming dimples 31 which fasten the orifice 5 to the tube 1, but allow removal of the orifice 5 from the tube 1. The holes 25 in the collar 21 provide a purchase for a variety of pulling tools which can be utilized to remove the orifice 5 even though the dimples 31 and groove 15 provide sufficient fastening to generally hold the orifice 5 against the end of the tube 1.

What is claimed is:

1. A removable orifice for a tube having a circumferential groove in its outer surface, said orifice comprising:

an orifice block having an orifice disposed therein and having an outer diameter generally equal to the outer diameter of the tube surface;

a skirt extending from one side of the orifice block and fitting inside said tube; and a continuous sleeve having a counterbore which fits over the outer diameter of said orifice block, the counterbore end of said sleeve extending beyond the outer edge of said circumferential groove and said sleeve being bent at a plurality of locations so as to engage said groove, said bent positions being the only fasteners utilized to hold said orifice adjacent said tube, whereby said sleeve and orifice may be quickly removed by pulling on the orifice.

2. A removable orifice as set forth in claim 1 and further comprising a tubular collar extending from the other side of said orifice block.

3. A removable orifice as set forth in claim 2 wherein said collar has a plurality of holes in the tubular portion.

4. A removable orifice as set forth in claim 1, wherein the orifice is aligned with the longitudinal axis of the skirt.

5. A removable orifice as set forth in claim 3, wherein the orifice, skirt and collar are aligned on a common longitudinal axis.

* * * * *